US008844767B1

(12) United States Patent
Bates et al.

(10) Patent No.: US 8,844,767 B1
(45) Date of Patent: Sep. 30, 2014

(54) FOOD CONTAINMENT AND DELIVERY SYSTEM

(75) Inventors: Peter Bates, Concord, MA (US); Kristin Heist, Cambridge, MA (US); Christine Horan, Marshfield, MA (US); Julie King, Fairview, TX (US); Elizabeth Kneen, Somerville, MA (US); Jason Robertson, Somerville, MA (US); David M. Sokolsky, Dallas, TX (US); Jung Geun Tak, Newton Upper Falls, MA (US); Vincent Taylor, Dallas, TX (US); Craig Ziemkiewicz, Allen, TX (US)

(73) Assignee: Daisy Brand, LLC, Dallas, TX (US)

( * ) Notice: Subject to any disclaimer, the term of this patent is extended or adjusted under 35 U.S.C. 154(b) by 94 days.

(21) Appl. No.: 13/543,624

(22) Filed: Jul. 6, 2012

(51) Int. Cl.
*B65D 35/00* (2006.01)

(52) U.S. Cl.
USPC ..... 222/107; 222/185.1; 222/212; 222/213; 222/494; 222/556

(58) Field of Classification Search
USPC ..... 222/107, 95, 185.1, 212–215, 490–491, 222/494, 556
See application file for complete search history.

(56) References Cited

U.S. PATENT DOCUMENTS

| | | | | |
|---|---|---|---|---|
| 4,749,108 | A * | 6/1988 | Dornsbusch et al. | 222/212 |
| 5,292,035 | A * | 3/1994 | Millar | 222/173 |
| 5,307,955 | A * | 5/1994 | Viegas | 222/107 |
| 5,373,965 | A * | 12/1994 | Halm et al. | 222/92 |
| D364,557 | S | 11/1995 | Linner | |
| 5,655,687 | A * | 8/1997 | Fitten et al. | 222/212 |
| 5,667,107 | A * | 9/1997 | Lindsey | 222/173 |
| D398,845 | S | 9/1998 | Wyslotsky | |
| 5,868,288 | A * | 2/1999 | Redmond et al. | 222/562 |
| 5,927,566 | A * | 7/1999 | Mueller | 222/490 |
| D423,361 | S | 4/2000 | Negre | |
| 6,079,594 | A * | 6/2000 | Brown et al. | 222/107 |
| D429,146 | S | 8/2000 | Thibiant et al. | |
| 6,131,806 | A * | 10/2000 | Hess et al. | 229/216 |
| 6,152,324 | A * | 11/2000 | Baudin | 222/1 |
| D459,212 | S | 6/2002 | Gobe | |
| 6,415,965 | B2 * | 7/2002 | Nyman et al. | 222/517 |
| 6,705,492 | B2 * | 3/2004 | Lowry | 222/184 |
| D541,171 | S | 4/2007 | Delmotte et al. | |
| D542,660 | S | 5/2007 | Thomas et al. | |
| D582,790 | S | 12/2008 | Friebe et al. | |
| D604,164 | S | 11/2009 | Miller et al. | |
| D626,860 | S | 11/2010 | Oates et al. | |
| 7,874,466 | B2 * | 1/2011 | McConville et al. | 222/494 |
| D638,719 | S | 5/2011 | Sander | |
| 7,959,036 | B2 * | 6/2011 | Koh | 222/209 |
| 8,087,547 | B1 * | 1/2012 | Lindsey | 222/184 |

(Continued)

FOREIGN PATENT DOCUMENTS

| | | | |
|---|---|---|---|
| EP | 2463213 | A1 | 6/2012 |
| WO | WO-2007031330 | A1 | 3/2007 |

*Primary Examiner* — Frederick C Nicolas
(74) *Attorney, Agent, or Firm* — Gardere Wynne Sewell LLP

(57) ABSTRACT

An inverted flexible food containment and delivery system is disclosed. Embodiments disclosed herein include a flexible pouch that is configured to contain a food product. A spout fitment is coupled to the flexible pouch proximate a dispensing end. The spout fitment supports a cap assembly that includes a valve. An exterior support surface of the cap assembly is configured to support the flexible food containment and delivery system and the food product in an inverted/cap-down orientation.

16 Claims, 2 Drawing Sheets

(56) References Cited

U.S. PATENT DOCUMENTS

D655,203 S 3/2012 Klint
D659,008 S 5/2012 Gately et al.
D664,862 S 8/2012 Smith et al.
D678,070 S 3/2013 Meeks

* cited by examiner

FOOD CONTAINMENT AND DELIVERY SYSTEM

TECHNICAL FIELD

The present invention relates generally to containment and delivery of food items, and more particularly to a flexible package for food items such as dairy products.

BACKGROUND

Food packaging serves a variety of functions, such as, for example, safe and generally sterile storage of food product. Of course, packages also function to contain the food product such that it remains fresh and tasty for consumption. In addition to containment of food product herein described, a consumer must also be able to easily dispense the food product conveniently and cleanly. However, different food products present different challenges for its respective packaging. For example, liquid commonly forms in voids or spaces inside sour cream packaging primarily due to "fracturing" or breaking apart of the sour cream, either from transport or use. Thus, when dispensing the sour cream, such liquid is dispensed with or in lieu of the sour cream making the sour cream oftentimes less desirable. Conventional sour cream cup containers, for example, account for such liquid buildup by allowing a user access to the cup container to gently stir the product to blend the sour cream and liquid together before serving; however, such mixing is burdensome and can reduce the freshness of the sour cream. This problem is further worsened by sour cream that is stored in plastic squeeze bottles, which draw air and other contaminants inside the container each time the product is dispensed from the container. For example, when dispensing product, pressure is applied to the bottle sidewalls to exert a sufficient force to push and/or otherwise discharge the product from the container. As the pressure is released, the sidewalls retract to their original non-deformed state creating a vacuum inside the container, which draws air and other contaminants inside the squeeze bottle. These pockets of air and contaminants cause liquid to accumulate, which can lead to an overall less desirable consumer experience.

SUMMARY

Embodiments disclosed herein are directed to a food containment and delivery system. The food containment and delivery system includes a flexible pouch that is configured to contain a food product, such as, for example, sour cream. A spout fitment is coupled to the flexible pouch proximate a dispensing end. The spout fitment supports a cap assembly that includes a valve to facilitate dispensing of the food product from the flexible pouch. Furthermore, an exterior planar surface of the cap assembly is configured to support the food containment and delivery system on a support surface in an inverted orientation (i.e., in a cap-down configuration such that the dispensing end/cap is located at the bottom of the flexible pouch).

The food containment and delivery system may be formed and filled in an inverted orientation, as opposed to conventional filling, which oftentimes occurs when the package is in an upright orientation. Once filled, the food containment and delivery system enables transport, storage and use in its inverted orientation. Accordingly, the content of the food containment and delivery system remains stable and is not disturbed by repeatedly inverting the system. This stability significantly reduces the amount of liquid that forms inside the package.

The food containment and delivery system also includes a valved cap, which provides distinct advantages. For example, the valved cap prevents food product from freely draining out of the system when the cap is opened. Furthermore, dispensing requires a slight pressure on the container, providing control over the amount dispensed.

Yet another technical advantage of the food containment and delivery system includes a deformable flexible pouch. As such, the flexible pouch provides the user a visual and tactile indication of the quantity of food product remaining in the package. The flexible pouch also allows dispensing of food product without creating negative pressure within the pouch, thereby preventing "suck-back" of air into the food containment and delivery system, which typically occurs with rigid/plastic sidewalls.

Other technical advantages will be readily apparent to one of ordinary skill in the art from the following figures, descriptions, and claims. Moreover, while specific advantages have been enumerated above, various embodiments may include all, some, or none of the enumerated advantages.

DETAILED DESCRIPTION OF THE DRAWINGS

Figure 1:
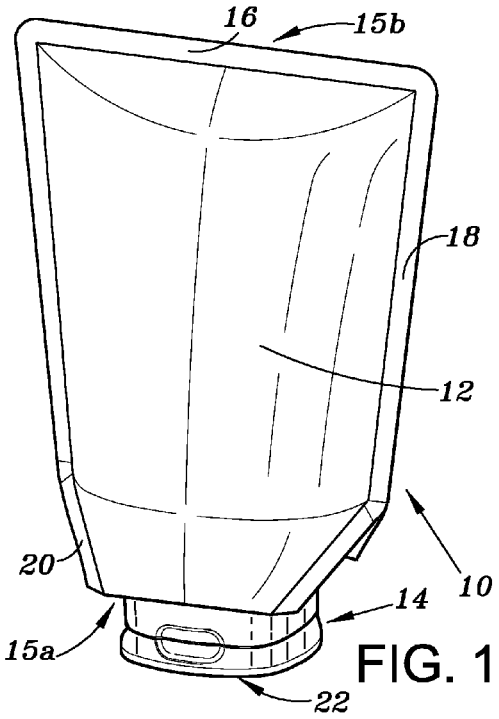
FIG. 1 is an isometric view of a flexible food containment and delivery system according to an embodiment of the present disclosure.

Reference is made to FIG. 1, which shows a food containment and delivery system 10 according to an embodiment of the present disclosure. The food containment and delivery system 10 includes a flexible pouch 12 and a cap 14 at a dispensing end 15*a*. In the embodiment illustrated in FIG. 1, the flexible pouch 12 is generally wedge-shaped with a thin non-dispensing end 15*b* disposed opposite the dispensing end 15*a*. Preferably, the flexible pouch 12 is formed of a laminar band or sheet of aluminum type foil; however, it should be understood that the flexible pouch 12 may be otherwise formed of any other type of material, such as a metalized film, a monolayer extruded film, a multi-layered extruded film, a multi-layered laminated film, or a co-extruded film, for example. When forming flexible pouch 12, as explained in greater detail below, a spout fitment 24 (best illustrated in FIG. 3) is secured to the sheet of foil, which may then be appropriately folded to form the flexible pouch 12, as shown for example, in FIG. 1.

In the embodiment illustrated in FIG. 1, a plurality of seals are formed on the edges of the sheet foil to form the flexible pouch 12, which is suitable to contain a food items, such as, but not limited to, sour cream, cottage cheese or whip cream. In FIG. 1, a single lateral seal 16 seals the non-dispensing end 15*b* of the flexible pouch 12 opposite the dispensing end 15*a*.

Figure 1A:
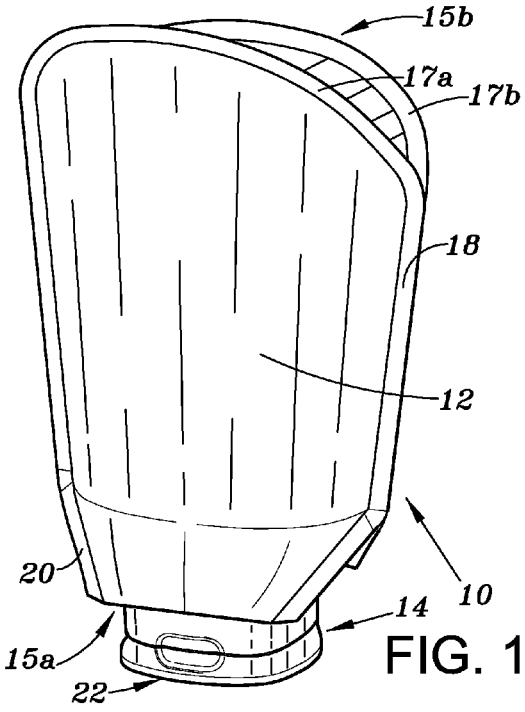
FIG. 1A is an isometric view of an alternate embodiment of the flexible food containment and delivery system of FIG. 1.

Each end of the lateral seal 16 intersects a respective longitudinal seal 18 and extends from the lateral seal 16 toward the dispensing end 15*a* of the pouch 12. In the embodiment illustrated in FIG. 1, longitudinal seals 18 merge into respective pairs of angled seals 20 (best seen in FIGS. 3 and 5). Each of the seals 16, 18 and/or 20 described herein may be formed by heat or ultrasonically welding portions of the folded foil edges. According to additional embodiments, flexible pouch 12 may be otherwise constructed. For example, in the embodiment illustrated in FIG. 1A, flexible pouch 12 includes two spaced apart lateral seals 17*a* and 17*b* at non-dispensing end 15*b*. Similar to the embodiment illustrated in FIG. 1, lateral seals 17*a* and 17*b* intersect with longitudinal seals 18 to form an expanded flexible pouch 12 at non-dispensing end 15*b*.

In the embodiments disclosed herein, the cap 14 includes a support surface 22 to enable the food containment and delivery system 10, and in particular, the flexible pouch 12, to be inverted (i.e., the non-dispensing end 15*b* being disposed above the dispensing end 15*a* with the cap facing downward as illustrated in FIG. 1) and supported on a support surface (i.e., a table, shelf, box, etc.). In this manner, gravity causes the contents of the food containment and delivery system 10 (i.e., the product) to remain stable and proximal to the dispensing cap 14 and not be disturbed by repeatedly inverting the system 10. Thus, when it is desired to deliver sour cream or other food product from within flexible pouch 12, the cap 14 is opened and the flexible pouch 12 is squeezed to deliver the food product through a valve 40 disposed at the dispensing end 15*a*, which causes the flexible pouch 12 to deform and otherwise collapse. In use, the flexible pouch 12 provides an indicator of the quantity of dairy product remaining in the container 10 (i.e., when the flexible pouch 12 is fully collapsed, no food product remains in the flexible pouch 12). The collapsing action of the flexible pouch also allows product to be dispensed without creating negative pressure inside the pouch 12, thereby preventing the entry of ambient, unsterile air inside the pouch 12 through the valve 40.

Figure 2:
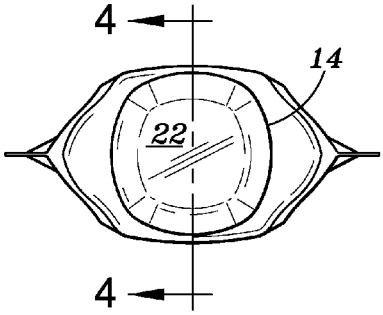
FIG. 2 is a top view of the food containment and delivery system of FIG. 1.

Reference is now made to FIG. 2, which shows the dispensing end 15*a* of the food containment and delivery system 10 of FIG. 1. As shown in FIG. 2, the support surface 22 of the cap 14 has a diameter substantially equal to a width of the flexible pouch 12. In some embodiments, the diameter may be slightly less or slightly greater than the maximum width of the pouch 12. In certain embodiments, the support surface 22 may be generally flat, and in an alternate embodiment a perimeter of the support surface may be slightly contoured (i.e., concave). Regardless, the cap 14 and the support surface 22 are sufficiently sized to provide a suitable surface for supporting the food containment and delivery system 10 in an inverted orientation, whether the pouch 12 is completely full, partially full, or even empty.

Figure 3:
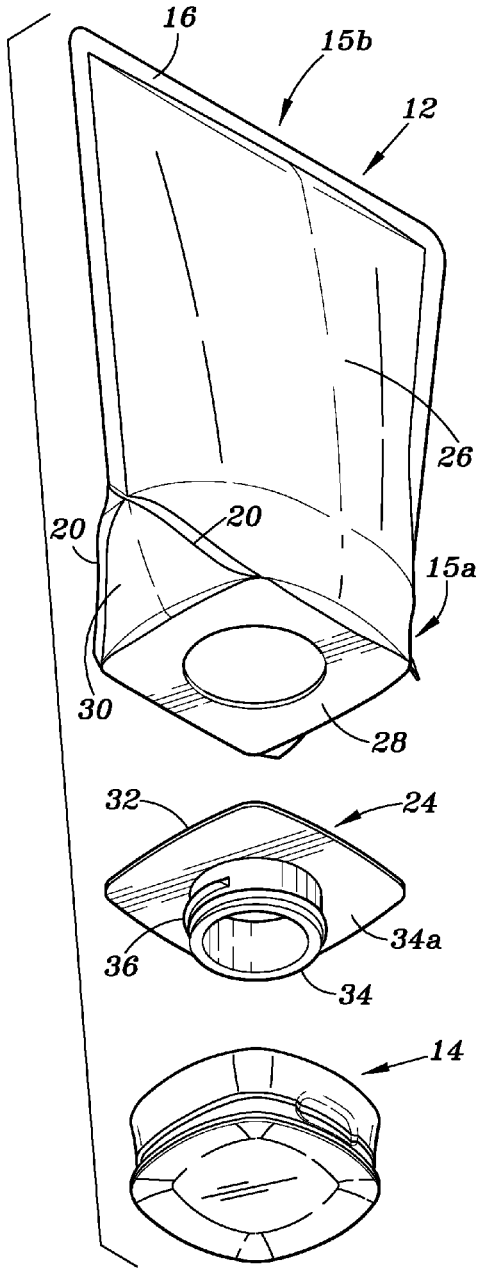
FIG. 3 is an isometric exploded view of the food containment and delivery system of FIG. 1.

FIG. 3 illustrates an exploded view of the food containment and delivery system 10 of FIGS. 1 and 2. In FIG. 3, the spout fitment 24 is disposed at least partially within the flexible pouch 12 and extends through an opening in the flexible pouch to receive and secure the cap 14 thereto. The spout fitment 24 includes a flange 32, which provides a surface to enable fastening to the flexible pouch 12, and a spout 34. The spout 34 may have spout threads 36, which receive or are received by corresponding threads on the cap 14 to secure the cap 14 to the spout 34.

The flexible pouch 12 generally comprises a wedge portion 26, a horizontal portion 28, and two opposed angled portions 30. The width of the flexible foil pouch 12 is formed by the flange 32, which in the embodiment illustrated herein, is part of the spout fitment 24. According to embodiments disclosed herein, the flange 32 may be generally square or rectangular in shape and a spout side 34*a* of the flange 32 is heat or ultrasonically welded or otherwise secured to the inside surface of the horizontal portion 28 of the flexible pouch 12 (best illustrated in FIG. 4). Subsequently, the sheet of foil is folded and sealed to form the flexible pouch 12 around the spout fitment 24.

In certain embodiments, the spout 34 may initially be sealed to allow the pouch 12 and the spout fitment 24 to be filled and sterilized. The spout fitment 24 may be molded from a polymer material, however, it should be understood that any other type of material may be utilized. In forming the fitment 24, the spout 34 may be in the form of a small tube with a closed or blocked dispensing end formed by the molding process. The closed spout 34 facilitates filling the pouch 12 through non-dispensing end 15*b*. To that end, after substantially forming the flexible pouch 12, the lateral seal 16 may be left open at the non-dispensing end 15*b*. That is, the lateral seal 16 may be only partially formed or not formed at all. Thus, the product to be stored within the flexible pouch 12 may be filled through the open edges of the pouch 12 that ultimately form the lateral seal 12. Once the flexible pouch 12 is filled, the lateral seal 16 is preferably formed by heat or ultrasonic welding to otherwise secure the edges together. Accordingly, the food containment and delivery system 10 may be formed, filled, stored, transported all while maintaining system 10 in the inverted orientation, which as previously explained, enables the content of the product stored therein to remain stable with minimal disturbance, which often occurs when inverting the system. The spout fitment seal may then be removed by the consumer, or the spout fitment seal may be removed before the product reaches the consumer in connection with the application of the cap 14 to the spout 34.

Figure 4:
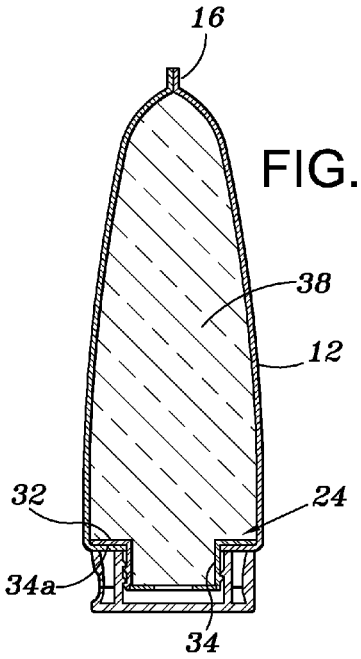
FIG. 4 is a section view of the food containment and delivery system of FIGS. 1 and 2 taken along the line 4-4 of FIG. 2.

FIG. 4 is a section view of the flexible pouch 12 illustrating its generally wedged shape. Flexible pouch 12 is sealed as shown and described herein to form a pouch cavity or storage area 38. The pouch 12 may be formed such that the cavity 38 is any desired volume. For example, the pouch cavity 38 may be configured to contain 12 ounces of dairy product in certain embodiments. In other embodiments, the pouch cavity 38 may be sized to contain 16 ounces of product. In other embodiments, for example, the pouch cavity may be sized to contain an amount of product that is less than 12 ounces.

Figure 5:
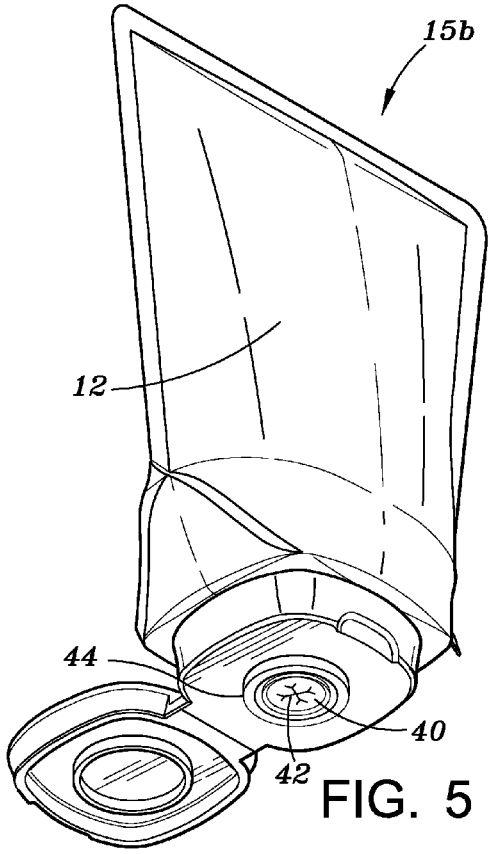
FIG. 5 is an isometric view of a food containment and delivery system with a cap configured in an open position and a valve in a closed position.
Figure 6:
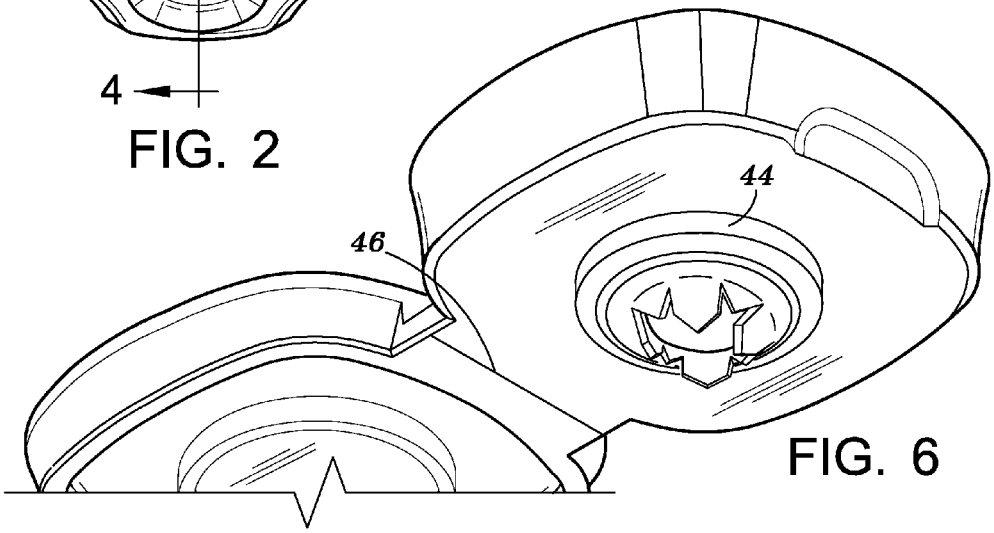
FIG. 6 is a detailed view of the valve of FIG. 5 in an open position.

Reference is now made to FIG. 5, which illustrates the food containment and delivery system 10 with the cap 14 in an open position thereby exposing the valve 40. The valve 40, when in a closed position, prevents the contents of the containment and delivery system 10 from inadvertently being delivered or otherwise leaking from the cavity 38. The valve 40 is preferably a perforated membrane of flexible and resilient material. In certain embodiments, the valve 40 may be a silicone membrane with perforations 42. The perforations 42 allow the silicone membrane to configure in a open position as best illustrated in FIG. 6. In its closed position, the valve 40 may be generally recessed into a raised annular portion 44 with performations generally adjacent each other to seal the cavity 38. When squeezing the flexible pouch 12 to deliver product from within the cavity 38, a force acts to separate the perforations 42, which opens the valve 40 thereby enabling delivery of the product from the flexible pouch 12. As the pressure on the pouch 12 is released, the opening force on the valve 40 is removed causing the valve 40, and in particular, the perforations 42, to return to the closed position to seal cavity 38. The valve 40 in turn returns to its recessed position within the raised annular portion 42. In this manner, the valve 40 closes and prevents the product from draining out through the dispensing opening when there is no pressure applied to the flexible pouch 12.

In operation, the flexibility of the pouch 12 enables the food product to be dispensed through the valve 40 without creating a negative pressure within the pouch. In particular, because the packaging collapses when dispensing product and such packaging does not have sufficient rigidity to return to its original non-collapsed state, the pouch 12 maintains a positive pressure condition at all times. This prevents the "suck-back" of air and other unwanted contaminants into the cavity 38, thereby reducing the formation of liquid within the cavity 38.

In the embodiments illustrated herein, the cap 40 includes a living hinge 46. The living hinge 46 allows the cap 40 to be flipped open so that the product may be delivered through the valve 40. When the product has been delivered, the cap 40 may be closed and snapped shut via frictional engagement. Thus, the product remains fresh and the containment and delivery system 10 may rest on the horizontal support surface 22 in a generally inverted orientation.

Embodiments of the invention have been described and illustrated above. The invention is not limited to the disclosed embodiments. Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A flexible food containment and delivery system for a dairy product, the system comprising:

a flexible pouch having a dispensing end and a non-dispensing end, the pouch forming a cavity to contain a dairy product therein;

a spout fitment at least partially disposed within the flexible pouch and extending at least partially through an opening proximate the dispensing end of the flexible pouch, wherein the spout fitment comprises a spout portion and a flange, the flange being secured to an interior surface of the flexible pouch;

a cap assembly coupled to the spout fitment and comprising a valve, the cap assembly having a support surface to support the flexible food containment and delivery system in an inverted cap-down orientation; and wherein the valve is operable between a closed position to maintain the dairy product inside the flexible pouch, and an open position to enable product to be dispensed from the flexible pouch, wherein in response to a pressure being exerted on the flexible pouch, the valve opens, and when pressure is removed, the valve is returned to the closed position.

2. The system of claim 1 wherein the flexible pouch is generally wedge-shaped.

3. The system of claim 2 wherein the non-dispensing end includes a lateral seal.

4. The system of claim 2 wherein:

the flexible pouch defines a horizontal portion at the dispensing end; and the exterior support surface of the cap is circular having a diameter substantially equal to a width of the horizontal portion of the flexible pouch.

5. The system of claim 1 wherein the flexible pouch has a horizontal portion at the dispensing end, the horizontal portion forming the interior surface.

6. The system of claim 1 wherein the flexible pouch is formed of a foil material.

7. The system of claim 1, wherein the flexible pouch is formed of at least of a metalized film, a monolayer extruded film, a multi-layered extruded film, a multi-layered laminated film or a co-extruded film.

8. The system of claim 1 wherein the valve comprises a perforated membrane of resilient material.

9. The system of claim 8 wherein the resilient material comprises silicone.

10. The system of claim 1 wherein the flexible pouch is filled with a dairy product.

11. The system of claim 10 wherein the dairy product is sour cream.

12. A flexible food containment and delivery system for a dairy product, the system comprising:

a wedge shaped flexible pouch having a cavity to contain a dairy product therein, the pouch having a dispensing end and a non-dispensing end, the non-dispensing end includes a lateral seal;

a planar support surface to support the flexible food containment and delivery system in an inverted cap-down orientation such that the dispensing end is generally located below the non-dispensing end;

a self closing valve disposed proximate the dispensing end; and wherein the self closing valve is operable between a closed position to maintain the dairy product inside the flexible pouch, and an open position to enable product to be dispensed from the flexible pouch, wherein in response to applying a pressure to deform the flexible pouch, the valve opens to release dairy product therefrom, and in response releasing the applied pressure, the flexible pouch remains deformed and the self closing valve returns to the closed position.

13. The system of claim 12 wherein the flexible pouch is formed of a foil material.

14. The system of claim 12 wherein the flexible pouch is formed of at least of a metalized film, a monolayer extruded film, a multi-layered extruded film, a multi-layered laminated film or a co-extruded film.

15. The system of claim 12 wherein the flexible pouch is filled with a dairy product.

16. The system of claim 15 wherein the dairy product is sour cream.

* * * * *